US007431130B2

(12) United States Patent
Hikita et al.

(10) Patent No.: US 7,431,130 B2
(45) Date of Patent: Oct. 7, 2008

(54) GROUP CONTROLLER OF ELEVATORS

(75) Inventors: Shiro Hikita, Tokyo (JP); Masaaki Amano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 540 days.

(21) Appl. No.: 10/557,365

(22) PCT Filed: Jun. 7, 2004

(86) PCT No.: PCT/JP2004/008237

§ 371 (c)(1),
(2), (4) Date: Nov. 17, 2005

(87) PCT Pub. No.: WO2005/121002

PCT Pub. Date: Dec. 22, 2005

(65) Prior Publication Data

US 2006/0289243 A1 Dec. 28, 2006

(51) Int. Cl.
*B66B 1/18* (2006.01)

(52) U.S. Cl. ..... 187/382; 187/392; 187/393

(58) Field of Classification Search ..... 187/380–388, 187/391–393, 281, 282, 247
See application file for complete search history.

(56) References Cited

U.S. PATENT DOCUMENTS

| | | | | |
|---|---|---|---|---|
| 4,166,518 | A * | 9/1979 | Nakazato et al. | 187/387 |
| 4,531,616 | A | 7/1985 | Uetani et al. | |
| 4,838,384 | A * | 6/1989 | Thangavelu | 187/385 |
| 4,947,965 | A * | 8/1990 | Kuzunuki et al. | 187/387 |
| 5,024,295 | A | 6/1991 | Thangavelu | |
| 5,266,757 | A | 11/1993 | Krapek et al. | |
| 5,490,580 | A * | 2/1996 | Powell et al. | 187/281 |
| 5,663,538 | A | 9/1997 | Sakita | |
| 5,780,786 | A | 7/1998 | Miyanishi | |
| 5,984,052 | A | 11/1999 | Cloux et al. | |
| 6,328,134 | B1 | 12/2001 | Hikita | |
| 6,394,232 | B1 * | 5/2002 | Iwata et al. | 187/382 |

FOREIGN PATENT DOCUMENTS

| | | |
|---|---|---|
| JP | 56-108673 | 8/1981 |
| JP | 61-054714 B2 | 3/1986 |
| JP | 04-226283 | 8/1992 |
| JP | 6-56361 | 3/1994 |
| JP | 08-053272 | 2/1996 |
| JP | 09-267977 | 10/1997 |
| JP | 11-180652 | 7/1999 |
| JP | 2001-278553 | 10/2001 |
| JP | 2003-238037 | 8/2003 |

* cited by examiner

*Primary Examiner*—Jonathan Salata
(74) *Attorney, Agent, or Firm*—Leydig, Voit & Mayer, Ltd.

(57) ABSTRACT

In an elevator group supervisory control apparatus, an estimation processing unit determines an estimated in-cage load in departing from a departure floor and estimates at least one of speed, acceleration, and jerk rate of the car in accordance with the estimated in-cage load to determine an estimated arrival time. An assignment unit selects and assigns a car serving as a response to a hall call on the basis of information from the estimation processing unit when the hall call is issued.

7 Claims, 4 Drawing Sheets

GROUP CONTROLLER OF ELEVATORS

TECHNICAL FIELD

The present invention relates to an elevator group supervisory control apparatus for controlling a plurality of control devices for controlling respective elevators.

BACKGROUND ART

In a normal elevator system, speed, acceleration, and jerk rate of each elevator are set in advance and not changed.

In contrast, in a conventional elevator apparatus disclosed in, for example, Japanese Patent No. 3029883, either means for speeding up a floor-to-floor moving time of each elevator or means for slowing down the floor-to-floor moving time of each elevator is selected depending on a traffic condition. Means for increasing the speed or acceleration of the car is used as the means for speeding up the floor-to-floor moving time of each elevator.

In this elevator apparatus, however, the in-cage load is not considered as a condition for changing the speed, the acceleration, and the jerk rate. This means that a hoisting machine (motor) capable of enduring high speed and high acceleration even in a fully occupied condition is required. This incurs a substantial increase in the cost of the whole elevator system.

Further, in many recent elevator systems, as soon as a passenger presses a call button in an elevator hall, a hall lantern is lit to inform the passenger of a responding unit. The estimated clock time at which a car of each elevator arrives at each floor constitutes a basis for such preannouncement of the responding unit. However, in the case where a plurality of elevator cars exist, when they are caused to travel at different speeds, accelerations, and jerk rates from each elevator, the process of estimation produces an error leading to a wrong preannouncement.

In addition, for example, JP 2001-278553 A discloses a method for increasing acceleration or jerk rate to its upper limit when the in-cage load is within a predetermined range.

In this elevator apparatus, however, since the maximum speed of the car is not changed while acceleration and jerk rate are changed, the traveling time of the car is not drastically reduced. In particular, when the car travels a long distance, the traveling time can be substantially reduced by increasing the speed. Still, a mere increase in acceleration and jerk rate does not lead to a significant reduction in traveling time.

DISCLOSURE OF THE INVENTION

The present invention has been made to solve the problems described above, and has an object to obtain an elevator group supervisory control apparatus capable of enhancing the efficiency of transportation and preventing a wrong preannouncement while employing a normal hoisting machine.

To this end, according to one aspect of the present invention, there is provided an elevator group supervisory control apparatus for controlling a plurality of elevators configured to change at least one of a speed, an acceleration, and a jerk rate of a car in accordance with a in-cage load, comprising: estimation processing means for determining an estimated in-cage load in departing from a departure floor and estimating at least one of a speed, an acceleration, and a jerk rate of the car in accordance with the estimated in-cage load to determine an estimated arrival clock time; and assignment means for selecting and assigning a car serving as a response to a hall call on the basis of information from the estimation processing means when the hall call is issued.

BEST MODES FOR CARRYING OUT THE INVENTION

Preferred embodiments of the present invention will be described hereinafter with reference to the drawings.

Figure 1:
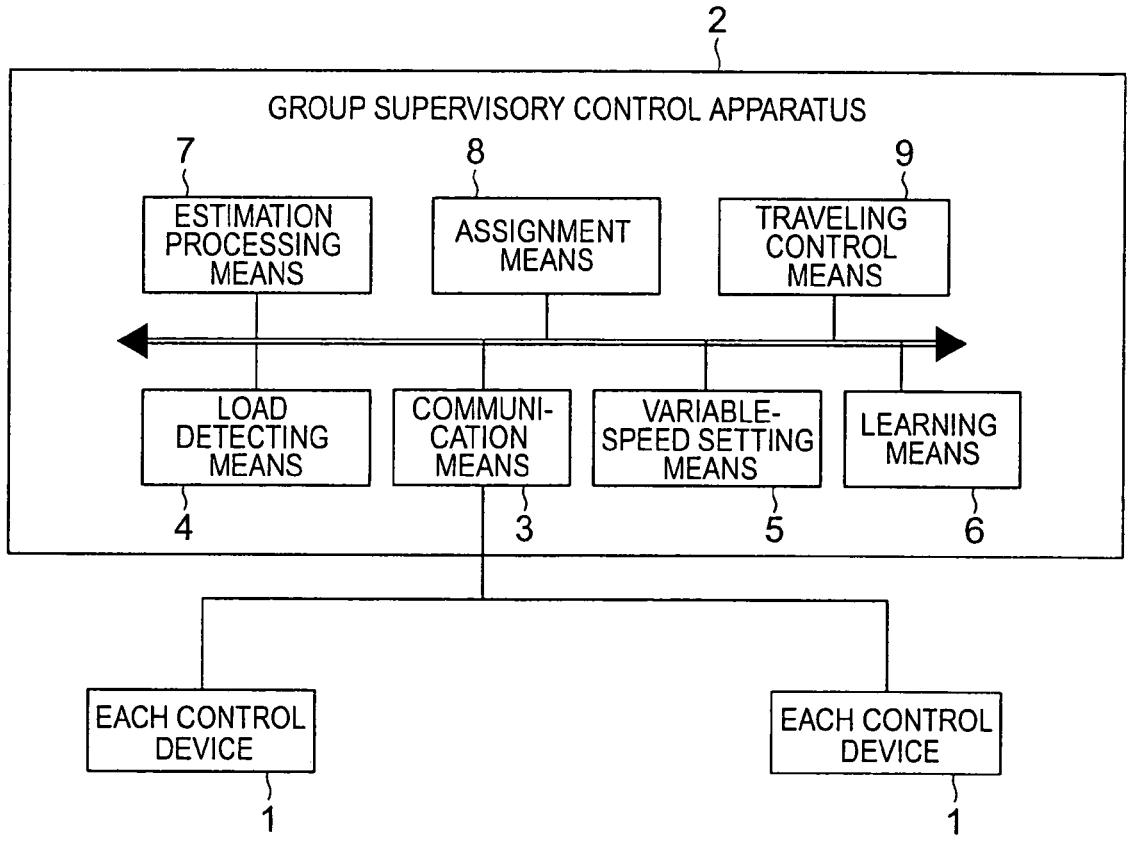
FIG. 1 is a block diagram showing a control device of an elevator system according to one exemplary embodiment of the present invention.

FIG. 1 is a block diagram showing a control device of an elevator system according to one exemplary embodiment of the present invention. Referring to the figure, the operation of each elevator is controlled by each control device 1. Accordingly, the number of elevators included in the elevator system is equal to the number of control devices 1 used. Each of the control devices 1 is controlled by a group supervisory control apparatus 2.

The group supervisory control apparatus 2 includes communication means 3, load detecting means 4, variable-speed setting means 5, learning means 6, estimation processing means 7, assignment means 8, and traveling control means 9. Those means 3 to 9 are constituted by pieces of software on a microcomputer. In other words, the group supervisory control apparatus 2 is constituted by a microcomputer having a CPU (processing portion) performing the functions of the means 3 to 9, a ROM (storage portion) in which programs executed by the CPU are stored, and a RAM into which arithmetic data and the like are written.

The communication means 3 establishes communication with the respective control devices 1 for the purpose of information exchange. The load detecting means 4 detects an in-cage load of each elevator based on a signal from a sensor provided in each elevator. The variable-speed setting means 5 sets the speed, the acceleration, and the jerk rate of each elevator on the basis of information from the load detecting means 4. The learning means statistically learns the traffic within a building and stores a learnt result.

The estimation processing means 7 performs a calculation for estimating the clock time when the car of each elevator arrives at each floor and a in-cage load at each floor, in accordance with the contents set by the variable-speed setting means 5 and information from the learning means 6. The assignment means 8 assigns a suitable elevator in response to a call issued in an elevator hall on the basis of a calculation result obtained from the estimation processing means 7. The traveling control means 9 controls the traveling of each elevator on the basis of an assignment result obtained from the assignment means 8.

Figure 2:
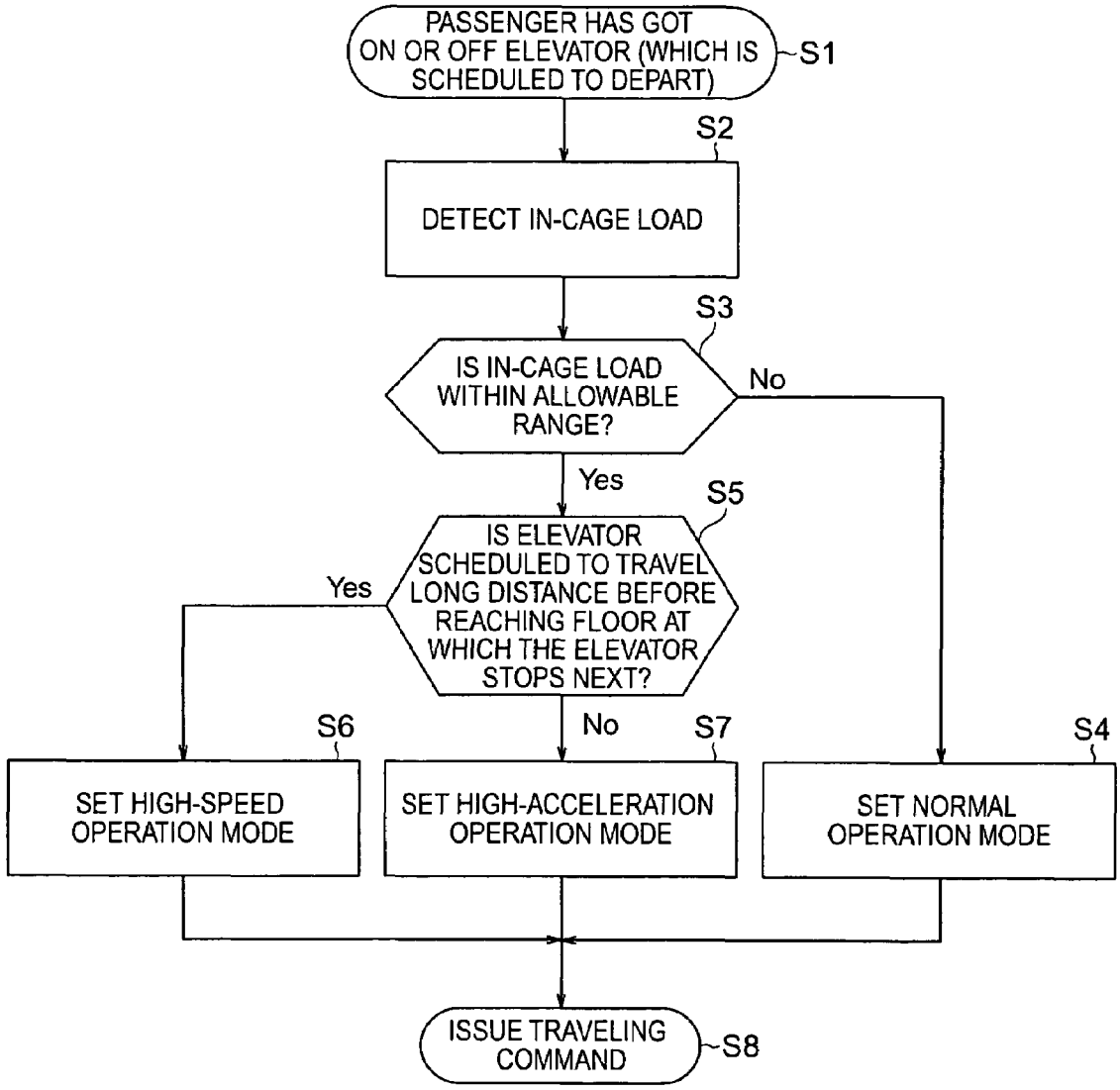
FIG. 2 is a flowchart for explaining a method of setting an operation mode by means of a group supervisory control apparatus of FIG. 1.

Next, an operation will be described. FIG. 2 is a flowchart for explaining a method of setting an operation mode by means of the group supervisory control apparatus 2 of FIG. 1. First, when it is detected that a passenger gets on or off an elevator from an elevator hall (step S1), an in-cage load of the elevator is detected (step S2). Note that when the car is not scheduled to travel after the passenger has got on or off the elevator, an automatic transition to a waiting operation is made, so that the procedures in step S2 and the following steps are not carried out.

When the car is scheduled to depart after the passenger has got on or off the elevator and the in-cage load has been detected, it is determined whether or not the in-cage load is within an allowable range for high-speed/high-acceleration operation. For instance, the following equation is used to make this determination.

$$(50-X)\%<(\text{in-cage load})<(50+X)\% \quad (1)$$

X %: threshold

The above equation (1) indicates that the in-cage load is within a predetermined range from a load balanced state (50%). The threshold (X%) can be theoretically set depending on the specification of employed pieces of hardware such as a hoisting machine (motor).

When it is determined that the in-cage load is not within the allowable range for high-speed/high-acceleration operation, the speed, the acceleration, and the jerk rate are set to normal values. In other words, the operation mode is set to a normal operation mode (step S4).

On the other hand, when it is determined that the in-cage load is within the allowable range for high-speed/high-acceleration operation, it is determined whether or not a traveling distance to a floor at which the car stops next is long (step S5). A reference distance as a criterion of this determination is, for example, an acceleration/deceleration distance. This acceleration/deceleration distance is calculated from the following equation.

$$S=V\{(V/\alpha)+T_0\} \quad (2)$$

S: acceleration/deceleration distance

V: speed $\alpha$: acceleration $T_0$: jerk time

The above equation (2) indicates an acceleration/deceleration distance of the car at a certain speed, a certain acceleration, and a certain jerk rate. When the traveling distance to the floor at which the car stops next is shorter than the acceleration/deceleration distance S, the car is decelerated and stopped before reaching the speed V. Therefore, the traveling time cannot be reduced even if the speed is set to be higher.

To put it the other way around, the traveling time can be reduced by increasing the speed only when the traveling distance is longer than a value calculated from the equation (2) based on the increased speed, a predetermined acceleration, and a predetermined jerk rate. In this case, the traveling distance is therefore regarded as a long distance when it is equal to or longer than the acceleration/deceleration distance calculated from the equation (2).

When it is determined that the traveling distance is a long distance, the traveling speed of the car is set to be high. In other words, the operation mode is set to a high-speed operation mode (step S6).

On the other hand, when it is determined that the traveling distance is not a long distance, the acceleration and the jerk rate are set to high values. In other words, the operation mode is set to a high-acceleration operation mode (step S7). By increasing the acceleration and the jerk rate, the traveling time is reduced to some extent even when the traveling distance is short.

The variable-speed setting means 5 of FIG. 1 makes a determination on the in-cage load, makes a determination on the traveling distance, and sets the operation mode.

When the operation mode is set as described above, a traveling command based on the set speed, the set acceleration, and the set jerk rate is outputted to each control device 1 (step S8).

In the foregoing description, one of the speed, the acceleration, and the jerk rate is selectively increased in accordance with the in-cage load. However, when the in-cage load assumes a certain value, the speed, the acceleration, and the jerk rate may be increased at the same time.

In the foregoing description, the speed, the acceleration, and the jerk rate are increased at a single stage. Instead, however, they may be increased by a plurality of stages.

When the speed, the acceleration, and the jerk rate are all changed at a plurality of stages, the following conditions are set for example.

When $(50-X_1)<(\text{in-cage load})<(50+X_1)$, speed: $V_1$, acceleration: $\alpha_1$, jerk rate $J_1$ When $(50-X_2)<(\text{in-cage load})<(50+X_2)$, speed: $V_2$, acceleration: $\alpha_2$, jerk rate $J_2$ The conditions as mentioned above are set in the form of, for example, a table and stored in the storage portion. Further, the conditions can be more finely set.

Figure 3:
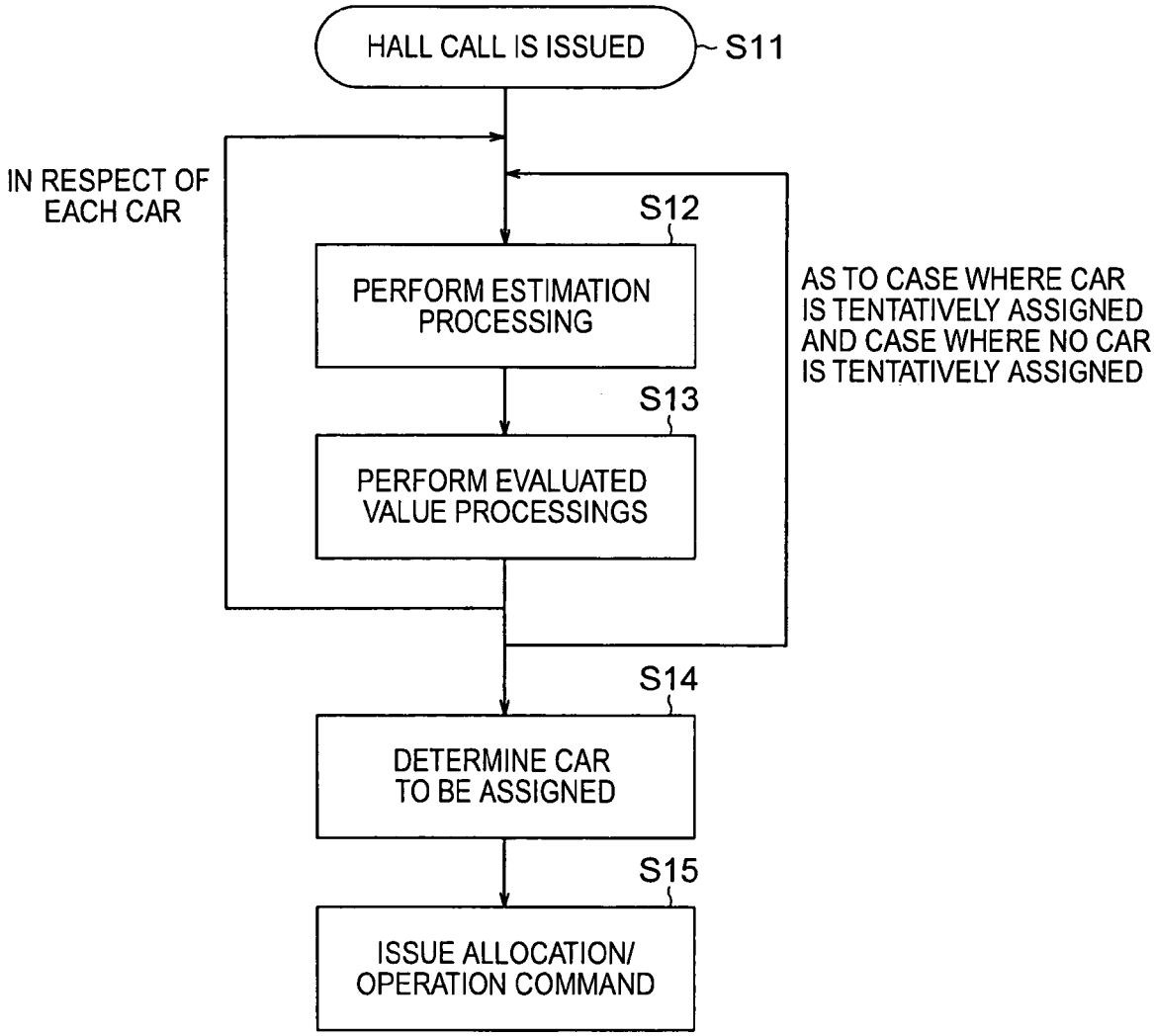
FIG. 3 is a flowchart for explaining a method of assigning cars by means of the group supervisory control apparatus of FIG. 1.

Next, FIG. 3 is a flowchart for explaining a method of assigning a car by means of the group supervisory control apparatus 2 of FIG. 1. First of all, when a hall call is issued (step S11), an estimated arrival clock time when each car can arrive at a floor where the hall call is issued, and an estimated value of a in-cage load in departing from a departure floor are calculated from estimation processing (step S12). The details of the estimation processing will be described later.

After the estimation processing has been performed, various evaluated value calculations are performed on the basis of a result of the estimation processing (step S13). Included in the evaluated value calculations are, for example, those for the evaluation of waiting time, fully occupied condition probability. Since concrete methods of performing such evaluated value calculations are known in the field of group supervisory control, the description thereof is omitted.

The estimation processing and the evaluated value calculations are performed in respect of each car, and as to a case where a car is tentatively assigned in response to a new hall call and a case where no car is assigned in response thereto, respectively.

After the estimation processing and the evaluated value calculations have all been completed, a car to be assigned in response to the hall call is determined (step S14). As a concrete method of allocation, there is adopted, for example, a method according to which such a car as minimizes the following comprehensive function values is selected.

$$J(e)=\min\{J(1), J(2), \ldots, J(N)\}$$

$$J(i)=w_1E_1(i)+w_2E_2(i)+w_3E_3(i)$$

e: assigned car

N: number of cars $E_1(i)$: sum of evaluated waiting times for respective hall calls which are being issued when car i (i=1, . . . , N) is assigned in response to a new hall call $E_2(i)$: sum of evaluated wrong preannouncement probability for respective hall calls which are being issued when car i is assigned in response to a new hall call $E_3(i)$: sum of evaluated fully-occupied condition probability for respective hall calls which are being issued when car i is assigned in response to a new hall call $w_1$, $w_2$, $w_3$: weight When the assigned car is determined as described above, an assignment operation command is issued to each control device 1 corresponding to the assigned car.

Figure 4:
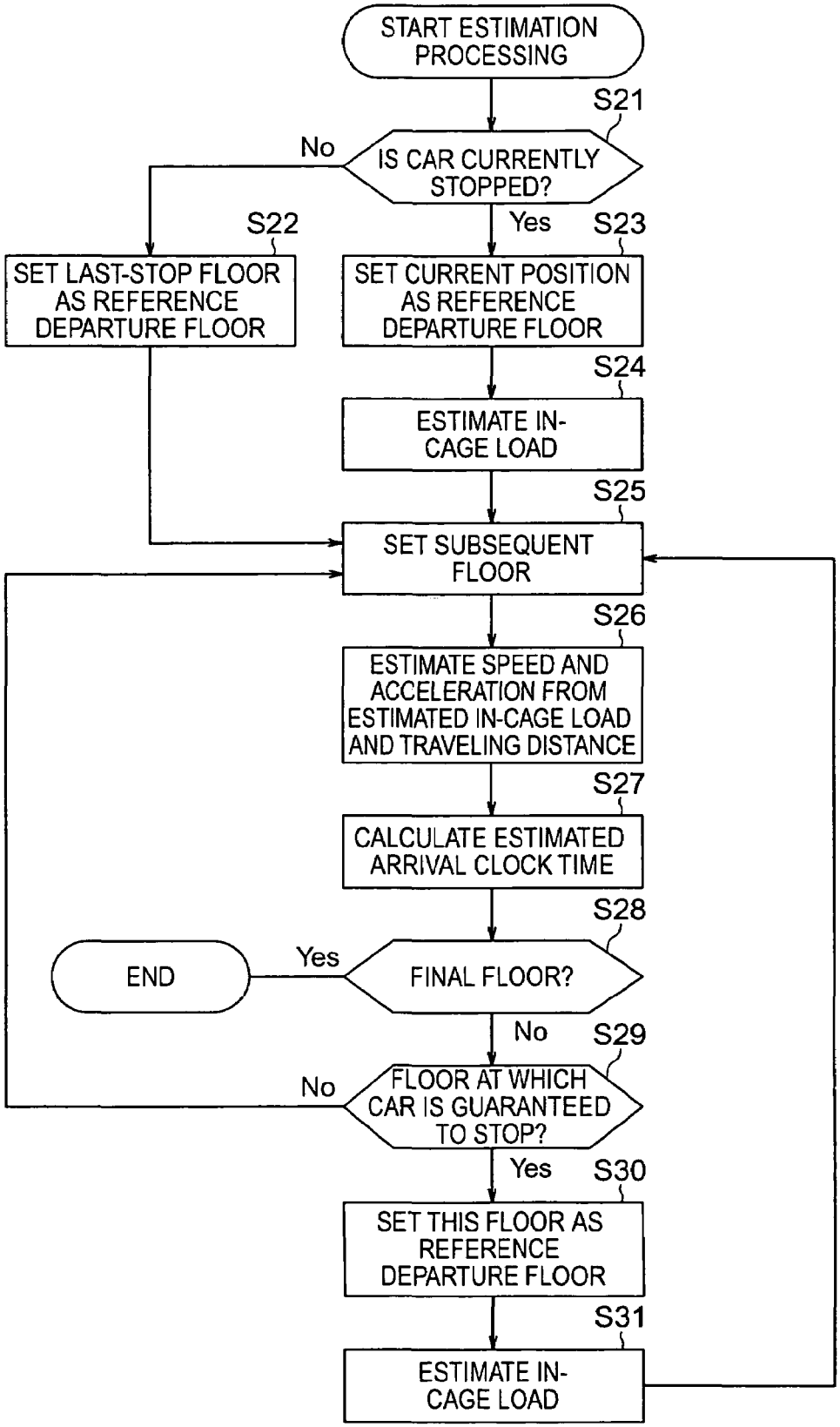
FIG. 4 is a flowchart for explaining a method of performing estimation processing of FIG. 3.

Next, FIG. 4 is a flowchart for explaining a method of performing the estimation processing of FIG. 3. When the estimation processing is started, it is first confirmed whether or not a relevant car has been stopped (step S21). When the car has not been stopped or is traveling, a last-stop floor (last-departure floor) is set as a reference departure floor (step S22).

On the other hand, when the car has been stopped, a current position of the car is set as the reference departure floor (step S23). Then, an in-cage load in departing from the reference departure floor is estimated (step S24). This estimation is made using a current number of passengers in the car, an estimated number of passengers getting on the car at the reference departure floor, and an estimated number of passengers getting off the car at the reference departure floor. The estimated number of passengers getting on the car is calculated depending on whether or not there is a hall call. The estimated number of passengers getting off the car is calculated depending on whether or not there is a car call. That is, the estimated in-cage load is calculated from the following equation.

(estimated in-cage load)=(current in-cage load)−(equivalent load value of estimated number of passengers getting off car)+(equivalent load value of estimated number of passengers getting on car)

Here, it should be noted that the learning means 6 calculates the estimated number of passengers getting on the car and the estimated number of passengers getting off the car on the basis of a statistically learnt result. Further, the equivalent load values can be easily calculated by setting an average weight per passenger in advance and using an equation: (equivalent load value)=(number of passengers)×(average weight).

Moreover, a stop time at the reference departure floor is calculated on the basis of the estimated number of passengers getting on the car, the estimated number of passengers getting off the car, a door opening-closing time, and the like, and an estimated departure clock time at the reference departure floor is calculated.

Next, a subsequent floor for which the estimated arrival clock time is to be calculated is set (step S25). This floor may be set as the reference departure floor+one floor when the car is traveling in the UP direction, and as the reference departure floor−one floor when the car is traveling in the DOWN direction. Then, a traveling distance from the reference departure floor to the subsequent floor is calculated. Then, a speed, acceleration, and a jerk rate in departing from the reference departure floor are estimated from the estimated in-cage load and the traveling distance (step S26). Those estimates are made in the same manner as in the procedures of steps S3 to S7 in FIG. 2.

After that, a traveling time is calculated from the traveling distance, the speed, the acceleration, and the jerk rate. An estimated arrival clock time is then calculated by adding the traveling time to the estimated departure clock time (step S27).

Next, it is confirmed whether or not the arrival floor for which the estimated arrival clock time has been calculated is a final floor for which the estimated arrival clock time is to be calculated (step S28). When it is the final floor, the calculations are completed. When it is not the final floor, it is confirmed whether or not the car is guaranteed to stop at that arrival floor in response to a car call or a hall call (step S29).

When the car is guaranteed to stop at that arrival floor, this floor is set as a new reference departure floor (step S30). Then, an in-cage load is estimated in the same manner as described above (step S31), and an estimated departure clock time is calculated. After that, the calculations in step S25 and the following steps are repeated. On the other hand, when the car is not guaranteed to stop at that arrival floor, the calculations in step S25 and the following steps are immediately repeated.

The estimated calculation means 7 of FIG. 1 performs the estimation processing described above.

The group supervisory control apparatus 2 as described above is adapted to change the speed, the acceleration, and the jerk rate of the car in accordance with the in-cage load and the traveling distance, thus making it possible to enhance the efficiency of transportation while employing a normal hoisting machine.

Further, the estimation processing means 7 calculates an estimated in-cage load, estimates a speed, an acceleration, and a jerk rate of the car in accordance with the estimated in-cage load, and calculates an estimated arrival clock time, thus making it possible to further enhance the efficiency of transportation and prevent the occurrence of a wrong preannouncement.

It is also possible to adopt a configuration in which some functional components of the group supervisory control apparatus 2, for instance, the load detecting means 4 and the variable-speed setting means 5 are provided on the side of each control device 1 so as to perform estimation processing and assignments on the basis of information from each control device 1.

Further, the variable-speed setting means provided in the group supervisory control apparatus may make an estimate to be utilized in the estimation processing means, while the variable-speed setting means provided in each control device may perform an actual variable-speed operation. Still further, an estimated result obtained from the estimation processing means in the group supervisory control apparatus may be utilized when performing a variable-speed operation in each control device.

The invention claimed is:

1. An elevator group supervisory control apparatus for controlling a plurality of elevators and changing at least one of speed, acceleration, and jerk rate of a car in accordance with an in-cage load, comprising:

estimation processing means for determining an estimated in-cage load upon departing from a departure floor and estimating at least one of speed, acceleration, and jerk rate of the car in accordance with the estimated in-cage load to determine an estimated arrival time; and assignment means for selecting and assigning a car serving in response to a hall call on based information from the estimation processing means when the hall call is issued.

2. The elevator group supervisory control apparatus according to claim 1, further comprising variable-speed setting means for setting the speed, the acceleration, and the jerk rate of a car in accordance with the in-cage load and traveling distance to a floor at which the car stops next, wherein the estimation processing means estimates the speed, the acceleration, and the jerk rate of the car in accordance with the estimated in-cage load and the traveling distance from the departure floor to a floor for which an estimated arrival time is to be calculated.

3. The elevator group supervisory control apparatus according to claim 2, wherein the variable-speed setting means sets the speed of the car high when the in-cage load is within a preset allowable range and the traveling distance to a floor at which the car stops next is equal to or longer than a preset reference distance, and sets the acceleration and the jerk rate of the car high when the traveling distance is shorter than the reference distance.

4. The elevator group supervisory control apparatus according to claim 1, wherein the estimation processing means determines the estimated in-cage load using current number of passengers in the car, estimated number of passengers getting on the car which has been determined depending on whether or not there is a hall call, and estimated number of passengers getting off the car which has been determined depending on whether or not there is a hall call.

5. The elevator group supervisory control apparatus according to claim 4, further comprising learning means for statistically learning traffic inside a building, wherein the learning means calculates the estimated number of passengers getting on the car and the estimated number of passengers getting off the car based on a statistically learned result.

6. The elevator group supervisory control apparatus according to claim 4, wherein the estimation processing means calculates an estimated departure time at the departure floor based on the estimated number of passengers getting on the car, the estimated number of passengers getting off the car, and door opening-closing time.

7. The elevator group supervisory control apparatus according to claim 1, wherein the assignment means performs evaluated value calculations, including a waiting time calculation, based on an estimation processing result, and selects a car corresponding to minimum evaluation function value.

* * * * *